US006045432A

United States Patent [19]

Shibata

[11] Patent Number: 6,045,432

[45] Date of Patent: Apr. 4, 2000

[54] EYEGLASS LENS LAYOUT INPUT DEVICE, AND LENS GRINDING APPARATUS

[75] Inventor: Ryoji Shibata, Aichi, Japan

[73] Assignee: Nidek Co., Ltd., Aichi, Japan

[21] Appl. No.: 09/050,945

[22] Filed: Mar. 31, 1998

[30] Foreign Application Priority Data

Mar. 31, 1997 [JP] Japan ..... 9-098218

[51] Int. Cl.[7] ..... B24B 9/14; G01B 7/28

[52] U.S. Cl. ..... 451/5; 451/8; 451/42

[58] Field of Search ..... 451/5, 41, 42, 451/43, 8; 33/200, 507

[56] References Cited

U.S. PATENT DOCUMENTS 5,138,770 8/1992 Matsuyama .
5,228,242 7/1993 Matsuyama .
5,333,412 8/1994 Matsuyama .
5,347,762 9/1994 Shibata et al. .

FOREIGN PATENT DOCUMENTS 3-20603 1/1991 Japan .

*Primary Examiner*—Timothy V. Eley
*Attorney, Agent, or Firm*—Sughrue, Mion, Zinn, Macpeak & Seas, PLLC

[57] ABSTRACT

An eyeglass lens layout input device for easily entering numeric values or altering displayed images. An eyeglass lens layout input device enters data to be used in providing a layout of a lens that corresponds to an eyeglass frame and sends the layout data to the lens grinding apparatus. The layout input device includes a selector that selects one of a plurality of entry items, and a rotary member which designates the value of a selected entry item by the direction and amount of its rotation. The rotary member is common to the plurality of entry items.

16 Claims, 8 Drawing Sheets

EYEGLASS LENS LAYOUT INPUT DEVICE, AND LENS GRINDING APPARATUS

BACKGROUND OF THE INVENTION

The present invention relates to a lens grinding apparatus for grinding the periphery of an eyeglass lens so that it conforms to the user's eyeglass frame. The invention also relates to an eyeglass lens layout input device for entering data to be used in providing a layout of each lens that corresponds to the eyeglass frame and which sends said layout data to an apparatus for grinding the lens.

An apparatus is known that is supplied with data on the configuration of the user's eyeglass frame or a template therefor and which grinds the periphery of eyeglass lens so that it conforms to the frame on the basis of the entered configurational data. To provide a layout for the optical center of each lens with respect to the shape of the user's eyeglass frame or a template therefor, the apparatus is supplied with the pupillary distance of the user and various other kinds of layout data. To this end, the apparatus has switches that are depressed to select specific items of layout data and ENTRY switches that are also depressed to enter the desired numeric values of a selected item. A known type of such ENTRY switches consists of a "+" key for increasing the numeral and a "−" key for decreasing it.

The "+" and "−" keys are also used to alter the edge position of a lens with respect to its configuration when displaying an image simulating the bevel shape.

Entering numeric values by means of key switches has had the following problems. In order to make a substantial change in numeric values, either the "+" or "−" key switch is kept depressed until a value near the desired one is reached and, thereafter, the switch is depressed finely enough to increment or decrement the value step by step. The first stage of the entering operation requires a careful watch of the displayed numeral; otherwise, the number you get will deviate greatly from the desired value. If the desired value is exceeded, an extra keying action is required to return to the desired value. If the desired value is yet to be reached, a fine adjustment is necessary. In addition, it takes time to make a substantial change in numerals. Thus, entering numeric values through the manipulation of key switches has not been highly efficient mainly because it is a nerve-racking job to obtain the desired value.

A further problem with the manipulation of key switches is that when altering the sectional edge position of a lens with respect to its configuration while looking at the image simulating the bevel shape, an alteration to the desired position is not a sensible step if it is done by manipulation of key switches.

SUMMARY OF THE INVENTION

The present invention has been accomplished under these circumstances and has as an object providing an eyeglass lens layout input device, with which commands for entering numeric values or altering displayed images can be implemented with sufficient ease to realize high operating efficiency.

Another object of the invention is to provide a lens grinding apparatus incorporating said eyeglass lens layout input device.

The present invention provides the following:

(1) An eyeglass lens layout input device for entering data to be used in providing a layout of a lens that corresponds to an eyeglass frame to send the layout data to a lens grinding apparatus, said device comprising:

selecting means for selecting one of a plurality of entry items classified to enter the layout data; and input value designating means, common to said plurality of entry items, including a rotatable rotary member which designates the value of a selected entry item by the direction and amount of the rotation of said rotary member.

(2) An eyeglass lens layout input device according to (1), wherein said plurality of entry items include items for entering the pupillary distance of a user and the height of the optical center relative to the center of the eyeglass frame, and wherein said input value designating means varies the input value in different steps that depend on the entry item selected by said selecting means.

(3) An eyeglass lens layout input device according to (1), further comprising:

an eyeglass frame configuration measuring means for measuring the eyeglass frame to obtain data on its configuration.

(4) A lens grinding apparatus for grinding a lens so that it conforms to an eyeglass frame, said apparatus comprising:

configuration data input means for entering data on the configuration of the eyeglass frame;

selecting means for selecting one of a plurality of entry items classified to enter data to be used in providing a layout of the lens that corresponds to the eyeglass frame;

input value designating means, common to said plurality of entry items, including a rotatable rotary member which designates the value of a selected entry item by the direction and amount of the rotation of said rotary member;

edge position detecting means which, on the basis of the data entered by said configuration data input means and said input value designating means, provides the edge position of the lens after processing;

processing data calculating means for computing data about the processing of the lens on the basis of the edge position determined by said edge position detecting means; and processing control means for processing the lens on the basis of said processing data.

(5) A lens grinding apparatus according to (4), further comprising:

bevel state display means by which the state of bevel after processing at a designated edge position is displayed on the basis of the processing data obtained by said processing data calculating means; and edge position designating means by which the edge position to be displayed by said bevel state display means is designated with respect to the frame configuration entered by said configuration data input means, wherein said edge position designating means includes said rotary member by which the edge position is designated in terms of the direction and amount of the rotation of said rotary member.

(6) The lens grinding apparatus according to (5), further comprising:

second selecting means for selecting an item for altering the position of the bevel apex in the state of bevel displayed by said bevel state display means, with the amount of alteration in the position of the bevel apex being designatable by said input value designating means.

DETAILED DESCRIPTION OF THE PREFERRED EMBODIMENT

Embodiments of the invention will now be described in detail with reference to the accompanying drawings.

Figure 1:
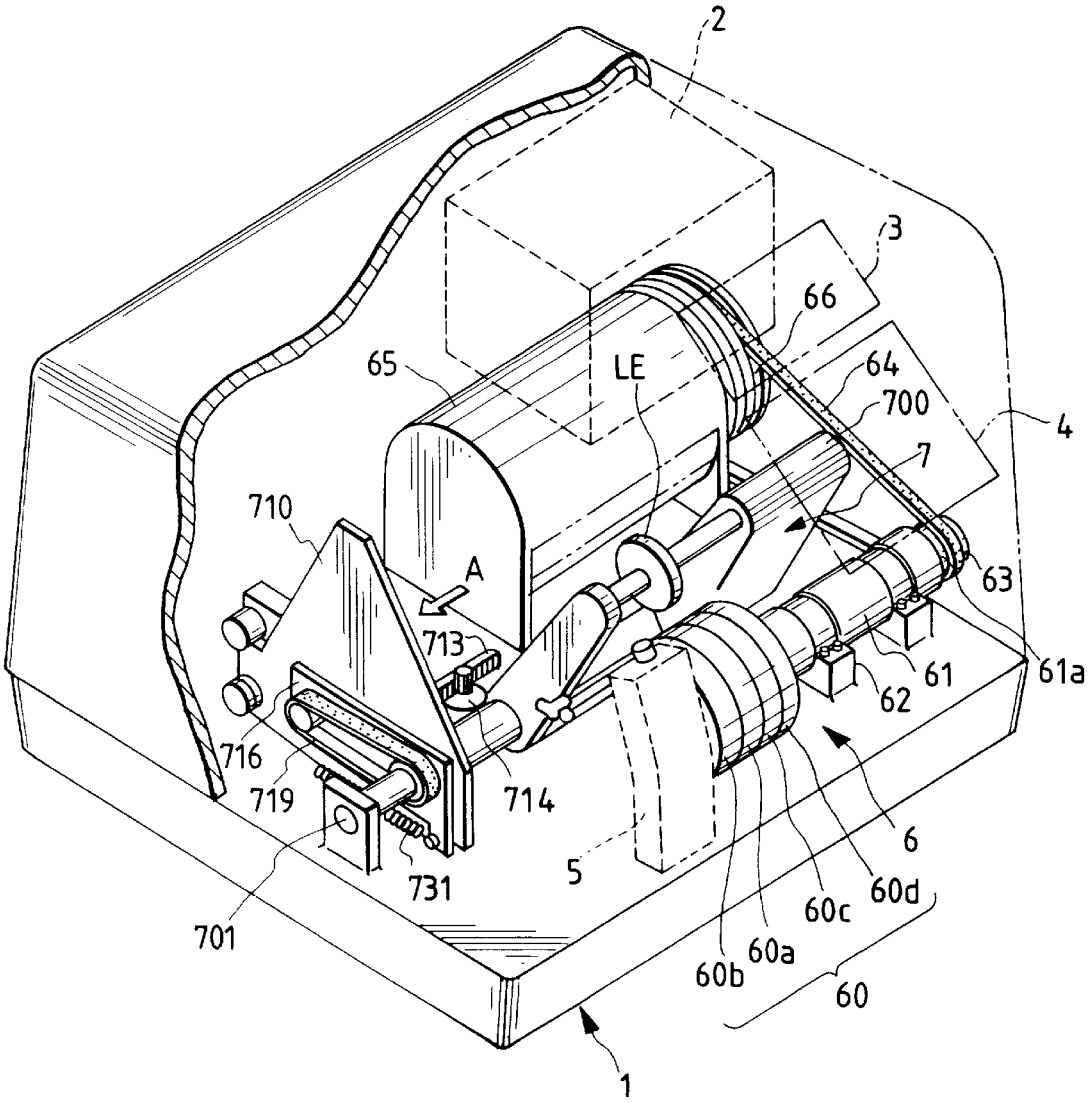
FIG. 1 is a perspective view showing the general configuration of the lens grinding apparatus of the invention.

FIG. 1 is a perspective view showing the general layout of the eyeglass lens grinding apparatus of the invention. The reference numeral 1 designates a base, on which the components of the apparatus are arranged. The numeral 2 designates an eyeglass frame and template configuration measuring device, which is incorporated in the upper section of the grinding apparatus to obtain three-dimensional configuration data on the geometries of the eyeglass frame and the template. Arranged in front of the measuring device 2 are a display device 3 which displays the results of measurements, arithmetic operations, etc. in the form of either characters or graphics, and an input device 4 for entering data or feeding commands to the apparatus. Provided in the front section of the apparatus is a lens configuration measuring device 5 for measuring the configuration (edge thickness) of an unprocessed lens.

The reference numeral 6 designates a lens grinding section, where an abrasive wheel group 60 made up of a rough abrasive wheel 60*a* for use on glass lenses, a rough abrasive wheel 60*b* for use on plastic lenses, a finishing abrasive wheel 60*c* for bevel (tapered edge) and plane processing operations, etc. is mounted on a rotating shaft 61*a* of a spindle unit 61, which is attached to the base 1. The reference numeral 65 designates an AC motor, the rotational torque of which is transmitted through a pulley 66, a belt 64 and a pulley 63 mounted on the rotating shaft 61*a* to the abrasive wheel group 60 to rotate the same. Shown by 7 is a carriage section and 700 is a carriage.

(Layout of the Major Components)

Next, the layout of the major components of the apparatus will be described.

(A) Carriage section

Figure 2:
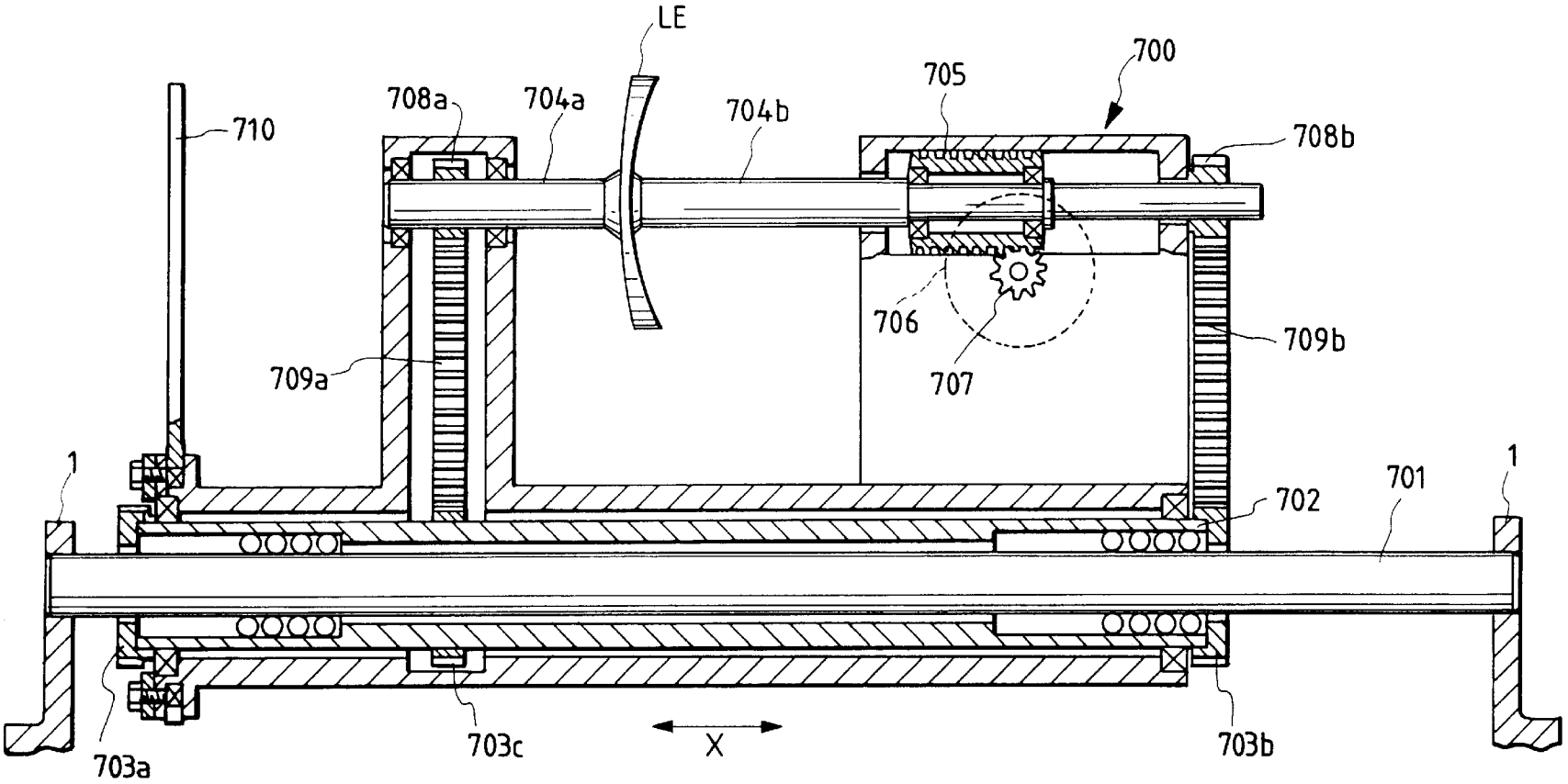
FIG. 2 is a sectional view illustrating the structure of a carriage.
Figure 3:
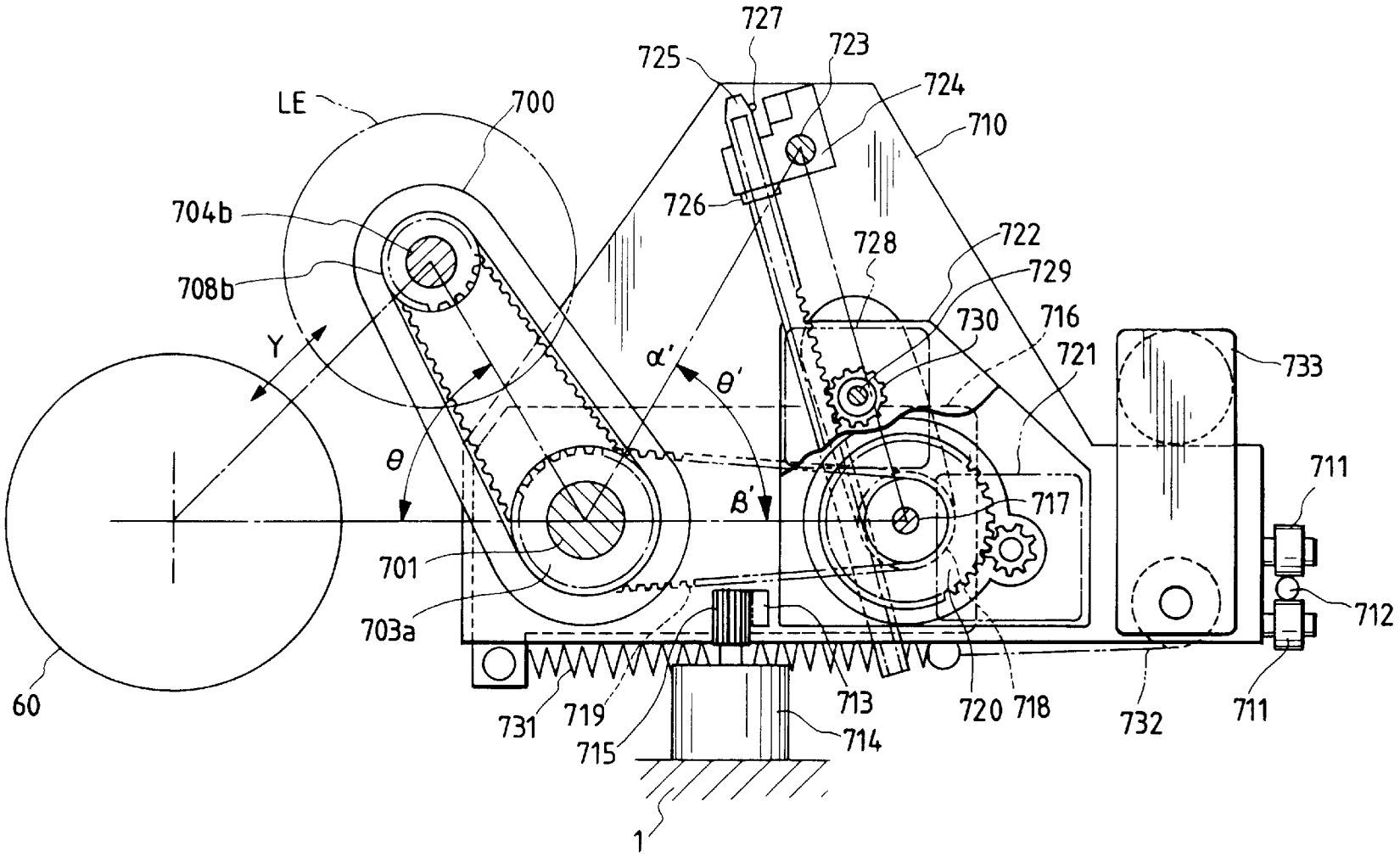
FIG. 3 is a section of a carriage drive mechanism as seen in the direction of arrow A in FIG. 1.

The construction of the carriage section will now be described with reference to FIGS. 1 to 3. FIG. 2 is a cross-sectional view of the carriage, and FIG. 3 is a diagram showing a drive mechanism for the carriage, as viewed in the direction of arrow A in FIG. 1.

A shaft 701 is secured on the base 1 and a carriage shaft 702 is rotatably and slidably supported on the shaft 701; the carriage 700 is pivotally supported on the carriage shaft 702. Lens rotating shafts 704*a* and 704*b* are coaxially and rotatably supported on the carriage 700, extending parallel to the shaft 701. The lens rotating shaft 704*b* is rotatably supported in a rack 705, which is movable in the axial direction by means of a pinion 707 fixed on the rotational shaft of a motor 706; as a result, the lens rotating shaft 704*b* is moved axially such that it is opened or closed with respect to the other lens rotating shaft 704*a*, thereby holding the lens LE in position.

A drive plate 716 is securely fixed at the left end of the carriage 700 and a rotational shaft 717 is rotatably provided on the drive plate 716, extending parallel to the shaft 701. A pulse motor 721 is fixed to the drive plate 716 by means of a block 722. The rotational torque of the pulse motor 721 is transmitted through a gear 720 attached to the right end of the rotating shaft 717, a pulley 718 attached to the left end of the rotating shaft 717, a timing belt 719 and a pulley 703*a* to the shaft 702. The rotational torque thus transmitted to the shaft 702 is further transmitted through timing belts 709*a*, 709*b*, pulleys 703*b*, 703*c*, 708*a* and 708*b* to the lens rotating shafts 704*a* and 704*b* so that the lens rotating shafts 704*a* and 704*b* rotate in synchronism.

An intermediate plate 710 has a rack 713 which meshes with a pinion 715 attached to the rotational shaft of a carriage moving motor 714, and the rotation of the pinion 715 causes the carriage 700 to move in an axial direction of the shaft 701.

The carriage 700 is pivotally moved by means of a pulse motor 728. The pulse motor 728 is secured to a block 722 in such a way that a round rack 725 meshes with a pinion 730 secured to the rotational shaft 729 of the pulse motor 728. The round rack 725 extends parallel to the shortest line segment connecting the axis of the rotational shaft 717 and that of the shaft 723 secured to the intermediate plate 710; in addition, the round rack 725 is held to be slidable with a certain degree of freedom between a correction block 724 which is rotatably fixed on the shaft 723 and the block 722. A stopper 726 is fixed on the round rack 725 so that it is capable of sliding only downward from the position of contact with the correction block 724. With this arrangement, the axis-to-axis distance r' between the rotational shaft 717 and the shaft 723 can be controlled in accordance with the rotation of the pulse motor 728 and it is also possible to control the axis-to-axis distance r between the abrasive wheel rotating shaft 61*a* and each of the lens rotating shafts 704*a* and 704*b* since r has a linear correlationship with r'.

The arrangement of the carriage section of the present invention is basically the same as that described in the commonly assigned U.S. Pat. No. 5,347,762, to which the reference should be made.

(B) Eyeglass Frame and Template Configuration Measuring Device

Figure 4:
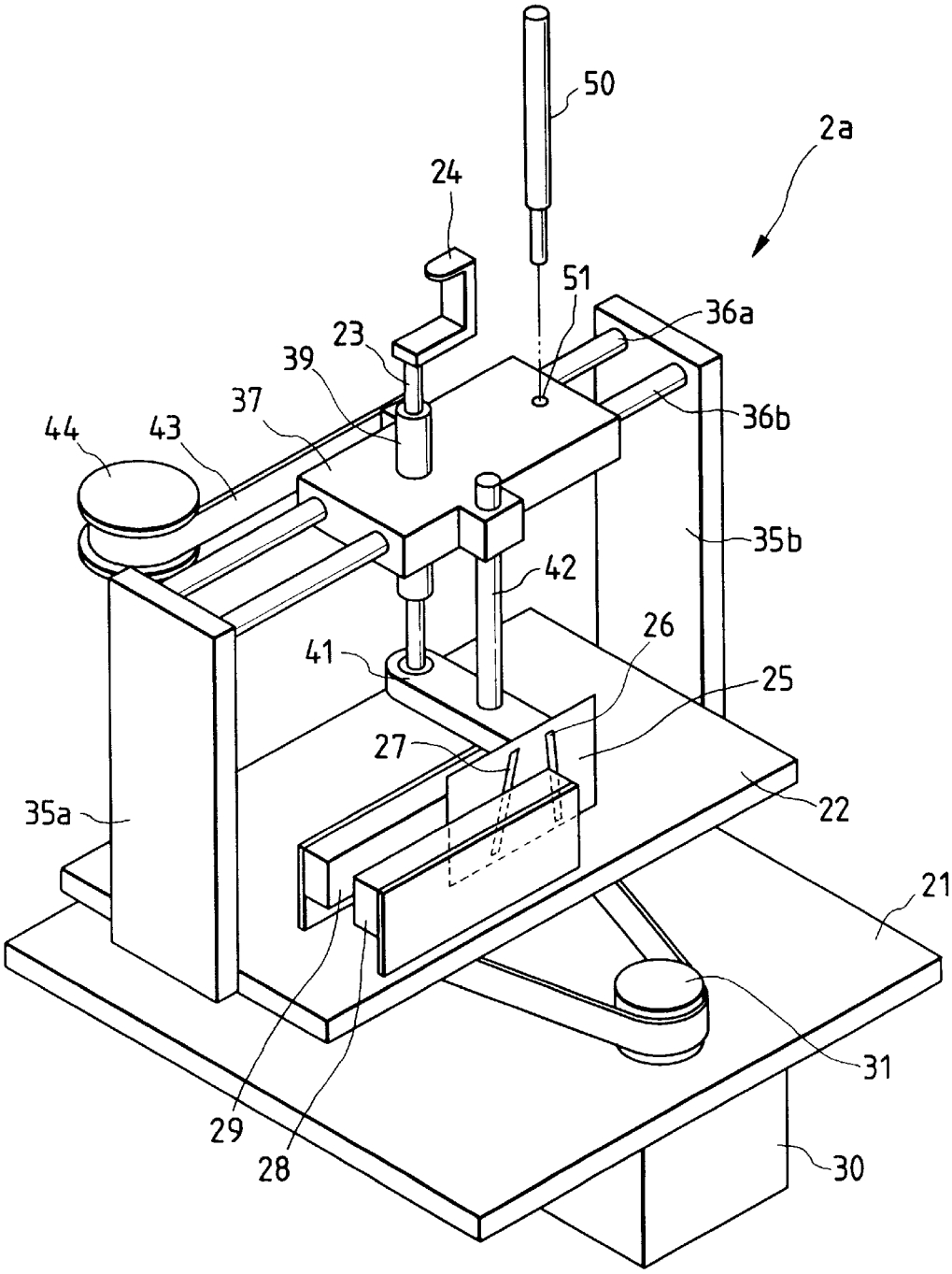
FIG. 4 is a perspective view of a configuration measuring section of an eyeglass frame and template configuration measuring device.

FIG. 4 is a perspective view of a configuration measuring section 2*a* of the eyeglass frame and template configuration measuring device 2. The configuration measuring section 2*a* comprises a moving base 21 which is movable in a horizontal direction, a rotating base 22 which is rotatably and axially supported on the moving base 21 and which is rotated by a pulse motor 30, a moving block 37 which is movable along two rails 36*a* and 36*b* supported on retainer plates 35*a* and 35*b* provided vertically on the rotating base 22, a gage head shaft 23 which is passed through the moving block 37 in such a way that it is capable of both rotation and vertical movements, a gage head 24 attached to the top end of the gage head shaft 23 such that its distal end is located on the central axis of the shaft 23, an arm 41 which is rotatably attached to the bottom end of the shaft 23 and is fixed to a pin 42 which extends from the moving block 37 vertically, a light shielding plate 25 which is attached to the distal end of the arm 41 and which has a vertical slit 26 and a 45° inclined slit 27, a combination of a light-emitting diode 28 and a linear image sensor 29 which are attached to the rotating base 22 to interpose the light shielding plate 25 therebetween, and a constant-torque spring 43 which is attached to a drum 44 rotationally and axially supported on the rotating base 22 and which normally pulls the moving block 37 toward the distal end of the head gage 24.

The moving block 37 also has a mounting hole 51 through which a measuring pin 50 is to be inserted for measurement of the template.

The configuration measuring section 2*a* having the construction just described above measures the configuration of the eyeglass frame in the following manner. First, the eyeglass frame is fixed in a frame holding portion (not shown but see, for example, U.S. Pat. No. 5,347,762) and the distal end of the gage head 24 is brought into contact with the bottom of the groove formed in the inner surface of the eyeglass frame. Subsequently, the pulse motor 30 is allowed to rotate in response to a predetermined unit number of rotation pulses. As a result, the gage head shaft 23 which is integral with the gage head 24 moves along the rails 36*a* and 36*b* in accordance with the radius vector of the frame and also moves vertically in accordance with the curved profile of the frame. In response to these movements of the gage head shaft 23, the light shielding plate 25 moves both vertically and horizontally between the LED 28 and the linear image sensor 29 such as to block the light from the LED 28. The light passing through the slits 26 and 27 in the light shielding plate 25 reaches the light-receiving part of the linear image sensor 29 and the amount of movement of the light shielding plate 25 is read. The position of slit 26 is read as the radius vector r of the eyeglass frame and the positional difference between the slits 26 and 27 is read as the height information z of the same frame. By performing this measurement at N points, the configuration of the eyeglass frame is analyzed as (rn, θn, zn) (n=1, 2, . . . , N). The eyeglass frame and template configuration measuring device 2 under consideration is basically the same as what is described in commonly assigned U.S. Pat. No. 5,138,770, to which reference should be made.

For measuring a template, the template is fixed on a template holding portion (see, for example, U.S. Pat. No. 5,347,762) and, the measuring pin 50 is fitted in the mounting hole 51. As in the case of measurement of the eyeglass frame configuration, the pin 50 will move along the rails 36*a* and 36*b* in accordance with the radius vector of the template and, hence, the position of slit 26 detected by the linear image sensor 29 is measured as information radius vector.

(C) Display Device and Input Device

Figure 5:
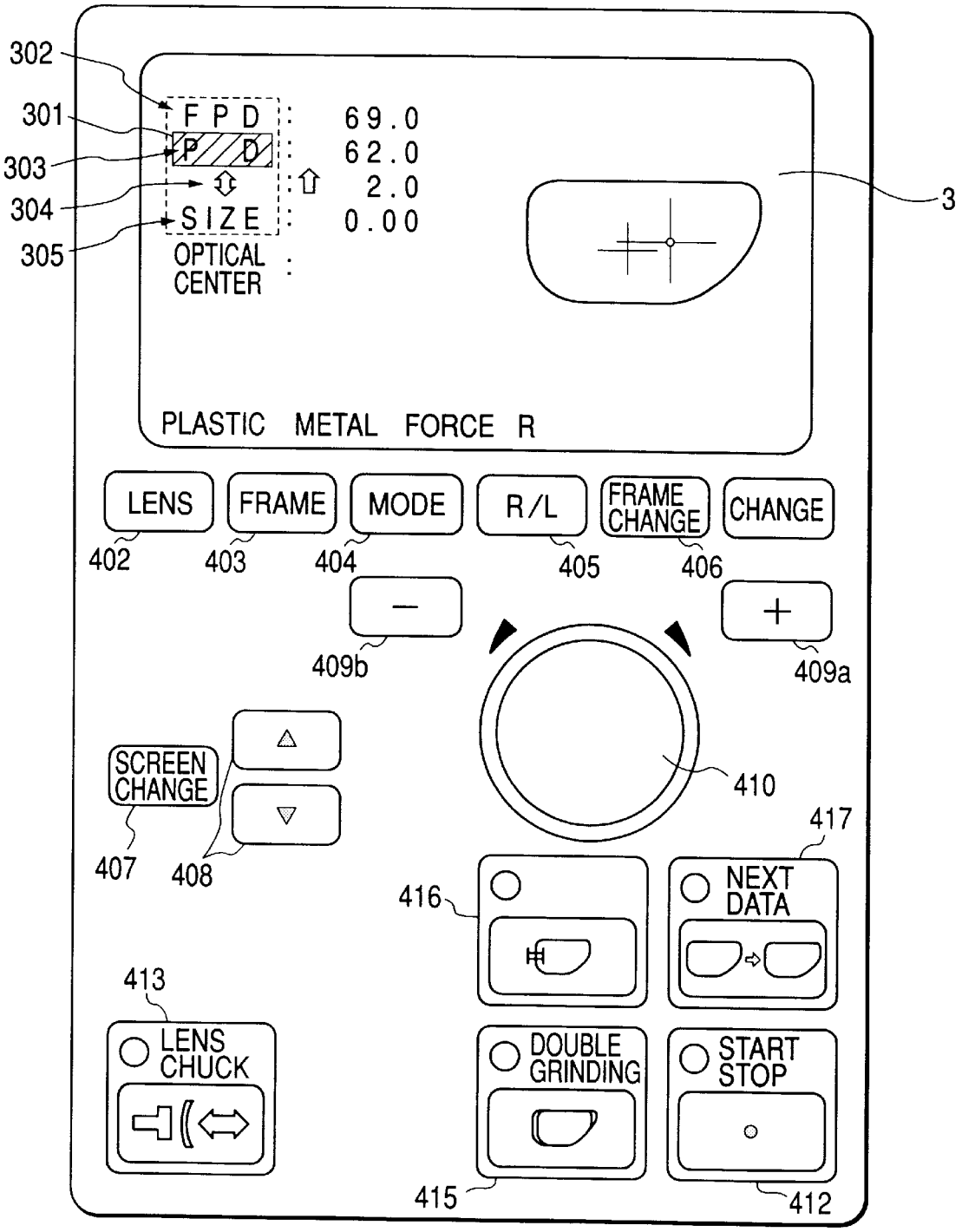
FIG. 5 is a diagram showing the exterior appearance of a display device and an input device.

FIG. 5 is a diagram showing the outer appearance of the display device 3 and the input device 4. The display device 3 is formed of a liquid-crystal display and, under the control of a main arithmetic control circuit to be described later, it displays, for example, a layout screen with which layout information can be input, and a bevel simulation screen on which the position of a bevel with respect to the target lens configuration and the cross-sectional condition of the bevel are simulated.

The input device 4 includes various setting switches such as a lens switch 402 for instructing the constituent material of the lens to be processed, a frame switch 403 for instructing the constituent material of the frame, a mode switch 404 for selecting the mode of lens processing to be performed (whether it is automatic processing for bevel, forced processing for bevel, plane processing, or the like), a R/L switch 405 for determining whether the lens to be processed is for use on the right eye or the left eye, a screen change switch 407 for selecting a screen to be displayed on the display device 3 (the layout screen, the menu screen or the parameter setting screen), move switches 408 for moving a cursor or arrow displayed on the display device 3 to thereby select items to be input, a "+" switch 409*a* and "−" switch 409*b* for numerical data input such that numerical values of the layout data to be input is increased or decreased, a rotation dial 410 for numerical data input, etc., a START/STOP switch 412 for starting or stopping the lens processing operation, a switch 413 for opening or closing the lens chucks, a tracing switch 416 for instructing the eyeglass frame and template tracing, and a next-data switch 417 for transferring the thus traced data. The rotation dial 410 is constructed by a rotary encoder, which, on the basis of its rotation direction and rotation angle, can increase or decrease numerical value of the input item selected by the move switch 408 in a predetermined stepwise manner.

(D) Electronic Control System for the Apparatus

Figure 6:
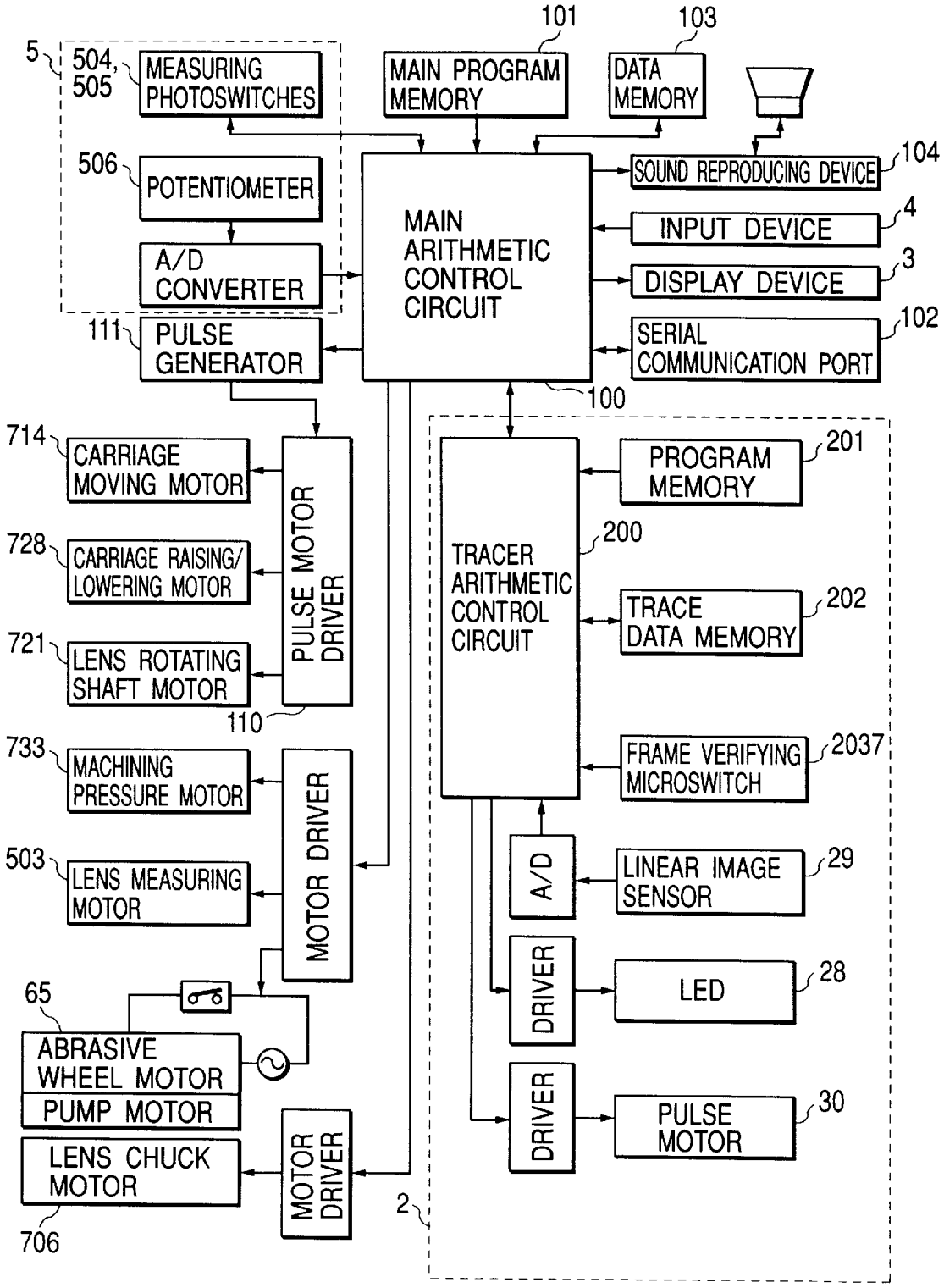
FIG. 6 shows the essential part of a block diagram for the electronic control system in the lens grinding apparatus.

FIG. 6 shows the essential part of a block diagram of the electronic control system for the eyeglass lens grinding apparatus of the invention. A main arithmetic control circuit 100 which is typically formed of a microprocessor and controlled by a sequence program stored in a main program memory 101. The main arithmetic control circuit 100 can exchange data with IC cards, eye examination devices and so forth via a serial communication port 102. The main arithmetic control circuit 100 also performs data exchange and communication with a tracer arithmetic control circuit 200 of the eyeglass frame and template configuration measurement device 2. Data on the eyeglass frame configuration are stored in a data memory 103.

The display device 3, the input device 4, a sound reproducing device 104 and the lens configuration measuring device 5 are connected to the main arithmetic control circuit 100. The measured data of lenses which have been obtained by arithmetic operations in the main arithmetic control circuit 100 are stored in the data memory 103. The carriage moving motor 714, as well as the pulse motors 728 and 721 are connected to the main arithmetic control circuit 100 via a pulse motor driver 110 and a pulse generator 111. The pulse generator 111 receives commands from the main arithmetic control circuit 100 and determines how many pulses are to be supplied at what frequency in Hz to the respective pulse motors to control their operation.

The apparatus having the above-described structural design operates in the following manner. First, an eyeglass frame (or a template therefor) is set on the eyeglass frame and template configuration measuring device 2 and the TRACE switch 416 is depressed to start tracing. The eyeglass frame data as obtained by the configuration measuring section 2*a* are stored in a TRACE data memory 202. When the NEXT DATA switch 417 is depressed, the data obtained by tracing are transferred into the apparatus and stored in the data memory 103. At the same time, graphics representing the target lens configuration (the frame configuration) is presented on the screen of the display device 3 based on the eyeglass frame data, rendering the apparatus ready for the entry of layout data and processing conditions.

Then, looking at the image on the display device 3, the operator manipulates the input device 4 to enter the necessary layout data, i.e., FPD (the distance between the centers of the user's eyeglass frame), PD (the pupillary distance of the user), the height of the optical center and the value of size correction, which are respectively indicated by numerical items 302 to 305. A particular item of entry is selected by moving a cursor 301 on the screen through manipulation of the two MOVE switches 408. To adjust the value of each item of entry, either "+" switch 409*a* or "−" switch 409*b* is depressed so that the value of a relevant item is incremented or decremented in a stepwise manner predetermined for each item. Similar adjustments can be made by rotating the dial 410. Turning the dial 410, the operator can sense a click feeling; when the dial is turned clockwise, the value of a selected item is increased in a predetermined stepwise manner and if it is turned counterclockwise, the value decreases in the predetermined stepwise manner.

Take, for example, the value of PD indicated by 303. When the eyeglass frame configuration data has been transferred to the grinding apparatus, an initial value of "62" in millimeters is displayed (it can be freely changed by parametric setting) and incremented or decremented in 0.5 (mm) steps until the desired value is reached. To make a substantial change in the value of PD, "+" switch 409*a* or "−" switch 409*b* has to be depressed a number of times in small steps or they have to be kept depressed until the desired value is reached, occasionally taking a long time to obtain the intended result. In contrast, quick changes can be accomplished by rotating the dial 410. Additionally, the sensible click provides ease in achieving fine adjustments. The value of FPD indicated by 302 is entered automatically on the basis of the data obtained by tracing the eyeglass frame. In the case of a template measurement, the rotary dial 410 or switches 409*a* and 409*b* may similarly be used to adjust the FPD in 0.5 (mm) steps until the desired value is reached. The height of optical center indicated by 304 can be adjusted in 0.1 (mm) steps and the value of size correction indicated by 305 can be adjusted in 0.01 (mm) steps.

Subsequently, the operator determines what the lens to be processed and the frame are made of, and in which mode the processing is to be performed and as to whether the lens to be processed is for use on the right or left eye and enters the necessary processing conditions through manipulation of the switches 402 to 405. On the pages that follow, the operation of the lens grinding apparatus in a forced bevelling mode will be described.

The lens to be processed is subjected to specified preliminary operations (e.g., centering of the suction cup) and placed in a cup holder mounted on the lens rotating shaft 704*a*. Then, the switch 413 is depressed so that the lens rotating shaft 704*b* is moved to the chucking position. Thereafter, the START/STOP switch 411 is depressed to turn on the lens grinding apparatus.

Figure 7:
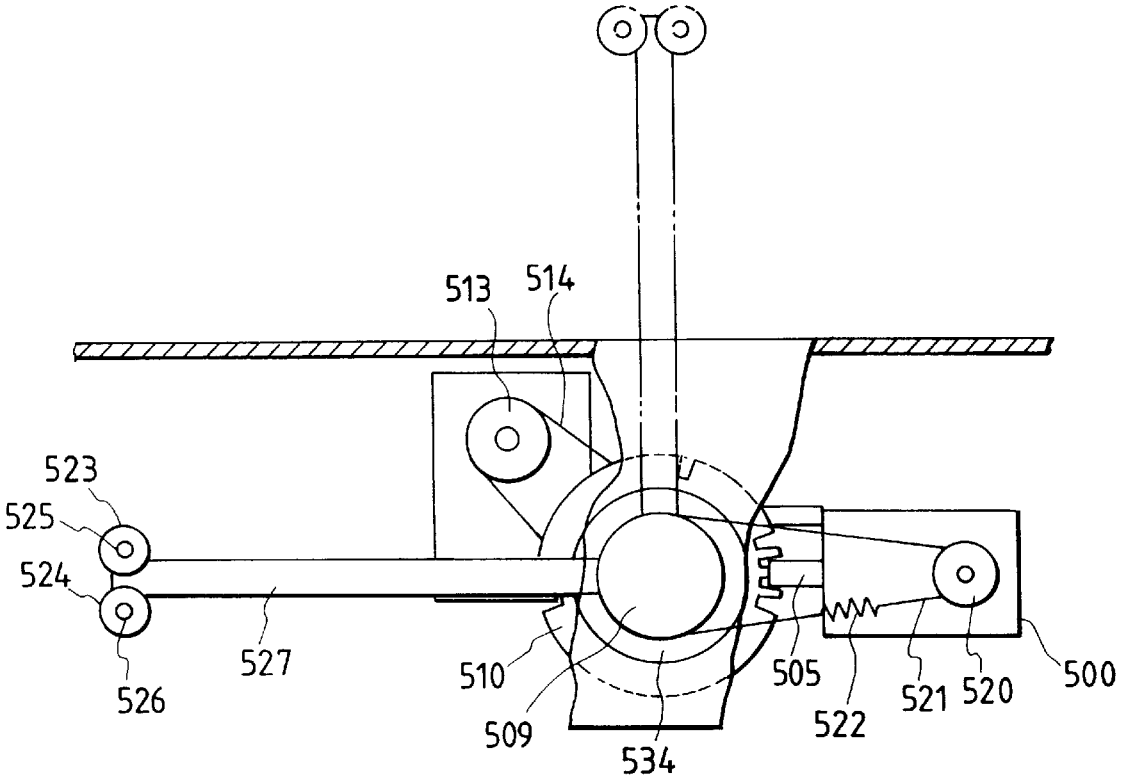
FIG. 7 is a diagram showing the structure of a lens configuration measuring device.

In response to the entry of a start signal, the apparatus performs arithmetic operations to effect processing correction (the correction of the radius of each abrasive wheel) on the basis of the entered data and subsequently turns on the lens configuration measuring device 5 to measure the configuration of the lens to be processed. For details of the processing correction, as well as the structure of the lens configuration measuring device 5 (see FIG. 7) and the procedure of lens configuration measurement, see U.S. Pat. No. 5,347,762.

The apparatus obtains bevelling data by performing bevel calculations for determining the position of the bevel apex based on the thus obtained data on lens configuration (edge position). The position of the bevel apex may be calculated by various methods including one of dividing the edge thickness of the lens by a specified ratio and a method in which the position of the bevel apex is displaced rearwardly by a specified amount from the position of the edge of the front surface of the lens and a bevel curve which is the same as the curve of the front surface is established. For further details of the bevelling process, see U.S. Pat. No. 5,347,762.

Figure 8:
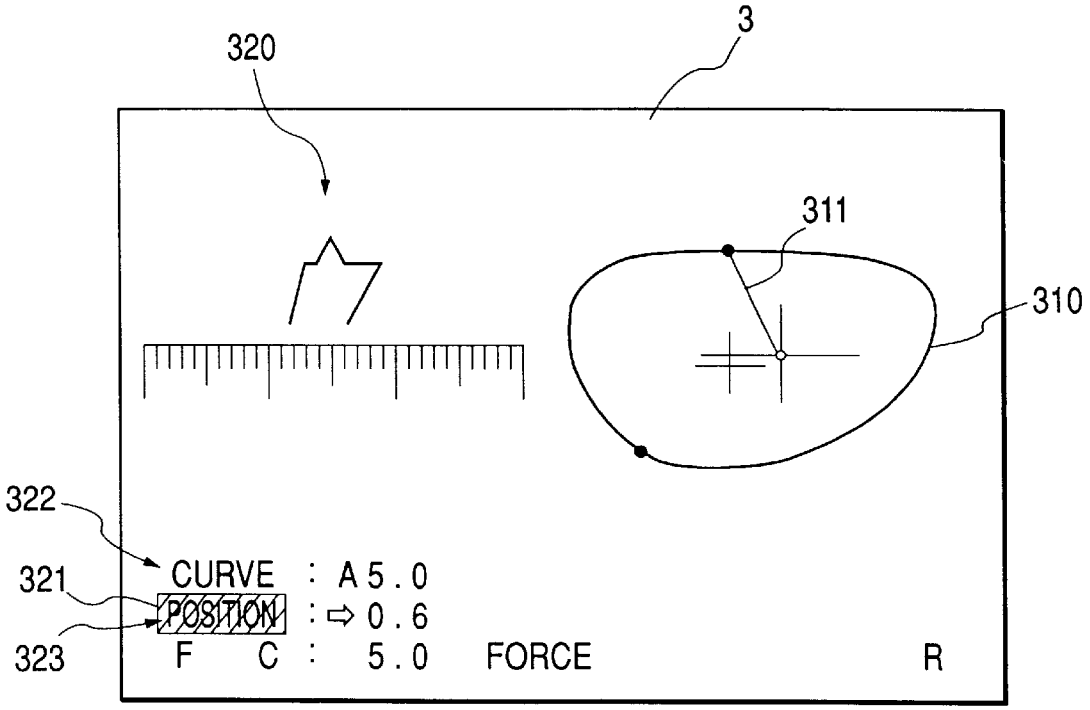
FIG. 8 is a diagram showing an example of the simulated image that appears in the display device.

When the bevel calculations are complete, the screen of the display device 3 changes to a simulated image as shown in FIG. 8, which displays a target lens shape 310 and a cursor 311 rotating on the processing center. Displayed on the left of the screen is the bevel's sectional shape 320 at the edge position pointed by the cursor 311. By manipulating the rotary dial 410, the cursor 311 can be freely moved and stopped in relation to the direction in which the dial is rotated and the amount of its rotation. As a result, the state of the bevel can be efficiently checked for the entire periphery of the lens, thus contributing to bevel formation in a balanced way. The cursor 311 is adapted to rotate clockwise when the "+" switch 409 is depressed and counterclockwise when the "−" switch 409*b* is depressed. If rotation through a large angle is necessary or if a stop is to be made in the desired position, the dial 410 can accomplish sensible manipulation more easily than the cursor 311.

In order to change the position of the bevel apex in the simulated image of the bevel shape, the MOVE switch 408 is depressed so that a cursor 321 pops up and it is moved to the area where "curve" or "position" is displayed and the relevant item is selected. If the item of "curve" indicated by 322 is selected, the value of a curve is altered such that the position of the bevel apex is moved back and forth based on the resulting curve value. If the item of "position" indicated by 323 is selected, the amount of an offset is entered so that the position of the bevel apex is shifted toward either front or rear surface of the lens. The values of the respective items are entered after proper adjustment is made with switches 409*a* and 409*b* or dial switch 410. The value of each item can be altered in a stepwise manner at a predetermined interval. Again, the dial 410 is more convenient than the switches 409*a* and 409*b* in the case of making a significant change or achieving the desired value.

After checking or altering the bevel shape shown in the simulated image, the START/STOP switch 411 is depressed to start lens grinding. Based on the entered processing data (or processing data after alteration by means of simulation), the apparatus controls the action of the carriage 700 as driven by the pulse motor 721, carriage moving motor 714 and pulse motor 728, such that the lens to be processed is pressed into contact with the rotating abrasive wheels 60 to perform rough grinding and finish grinding in succession.

While the present invention has been described above with reference to a lens grinding apparatus having the eyeglass frame and template configuration measuring device 2 as an integral part, it should be noted that the concept of the invention is also applicable to another case that the lens grinding apparatus is discrete from the eyeglass frame and template configuration measuring device 2, as well as from an input device 4 for entering layout data, and a display device 3. In this case, data on the configuration of the user's eyeglass frame and layout data are transferred to the grinding apparatus, which then performs the necessary processing.

As described on the foregoing pages, the present invention provides a lens grinding apparatus and an eyeglass lens layout input device that allow the desired numeric data to be entered or altered and the displayed image to be changed so easily that the operator can perform highly sensible lens processing with good maneuverability.

What is claimed is:

1. An eyeglass lens layout input device for entering data to be used in providing a layout of a lens that corresponds to an eyeglass frame to send layout data to a lens grinding apparatus, said device comprising:

selecting means for selecting one of a plurality of entry items which receive layout data; and input value designating means, common to said plurality of entry items, including a rotatable rotary member which designates the value of a selected entry item by the direction and amount of rotation of said rotary member.

2. An eyeglass lens layout input device according to claim 1, wherein said plurality of entry items include items for entering the pupillary distance of an eyeglass lens user and the height of the optical center relative to the center of the eyeglass frame, and wherein said input value designating means varies the input value in different steps that depend on the entry item selected by said selecting means.

3. An eyeglass lens layout input device according to claim 1, further comprising:

an eyeglass frame configuration measuring means for measuring the eyeglass frame to obtain data on its configuration.

4. A lens grinding apparatus for grinding a lens so that it conforms to an eyeglass frame, said apparatus comprising:

configuration data input means for entering data on the configuration of the eyeglass frame;

selecting means for selecting one of a plurality of entry items which receive data to be used in providing a layout of the lens that corresponds to the eyeglass frame;

input value designating means, common to said plurality of entry items, including a rotatable rotary member which designates the value of a selected entry item by the direction and amount of rotation of said rotary member;

edge position detecting means which, on the basis of the data entered by said configuration data input means and said input value designating means, provides the edge position of the lens after processing;

processing data calculating means for computing data about the processing of the lens on the basis of the edge position determined by said edge position detecting means; and processing control means for processing the lens on the basis of said processing data.

5. A lens grinding apparatus according to claim 4, further comprising:

bevel state display means by which a state of bevel of a lens edge after processing at a designated edge position is displayed on the basis of the processing data obtained by said processing data calculating means; and edge position designating means by which the edge position to be displayed by said bevel state display means is designated with respect to the frame configuration entered by said configuration data input means, wherein said edge position designating means includes said rotary member by which the edge position is designated by the direction and amount of the rotation of said rotary member.

6. The lens grinding apparatus according to claim 5, further comprising:

second selecting means for selecting an item for altering the position of a bevel apex in the state of bevel displayed by said bevel state display means, with an amount of alteration in the position of the bevel apex being designatable by said input value designating means.

7. An eyeglass lens layout input device for entering data to be used in providing a layout of a lens that corresponds to an eyeglass frame to send layout data to a lens grinding apparatus, said device comprising:

a display device which displays an indicator and at least two entry items which receive layout data; and an input device which includes:

at least one move switch which moves said indicator to thereby select one of the at least two entry items; and a rotation dial, commonly associated with said at least two entry items, which designates the value of a selected entry item by the direction and amount of rotation of said rotation dial.

8. An eyeglass lens layout input device according to claim 7, wherein said at least two entry items include an item for entering a pupillary distance of a user and an item for entering the height of the optical center relative to the center of the eyeglass frame, and wherein the rotary dial varies the input value in different steps that depend on the entry item selected by the at least one move switch.

9. An eyeglass lens layout input device according to claim 7, further comprising:

an eyeglass frame configuration measuring device which includes:

a base;

a moving block which is connected to said base, and is movable relative to said base;

a gage head connected to said moving block, wherein said gage head is disposed so as to contact an eyeglass frame.

10. An eyeglass lens layout input device according to claim 9, wherein said base includes a moving base and a rotating base which is rotatably and axially supported on the moving base, said moving block is connected to said rotating base, and said eyeglass frame configuration measuring device further includes a spring which biases said moving block to one position with respect to said rotating base.

11. An eyeglass lens layout input device according to claim 9, wherein said gage head is connected to a shielding plate which moves along with said gage head, and said eyeglass frame configuration measuring device further includes a light source and a light detector connected to said base, said light source and said light detector being mounted adjacent opposite sides of said shielding plate.

12. A lens grinding apparatus for grinding a lens so that it conforms to an eyeglass frame, said apparatus comprising:

a main base;

an eyeglass frame configuration measuring device, mounted on said main base, which includes:

a base;

a moving block which is connected to said base, and is movable relative to said base;

a gage head connected to said moving block, wherein said gage head is disposed so as to contact and trace an eyeglass frame to thereby provide measurement data on the eyeglass frame;

a display device, adjacent said main base, which displays an indicator and at least two entry items which receive data to be used in providing a layout of the lens that corresponds to the eyeglass frame;

an input device, adjacent said main base, which includes:

at least one move switch which moves said indicator to thereby select one of the at least two entry items; and a rotation dial, commonly associated with said at least two entry items, which designates the value of a selected entry item by the direction and amount of rotation of said rotation dial;

an edge position calculating circuit connected to said eyeglass frame configuration measuring device and to said input device, wherein said edge position calculating circuit calculates, on the basis of the measurement data obtained by said eyeglass frame configuration measuring device, and the data input by said input device, the edge position of the lens after processing;

a processing data calculating circuit, connected to said edge position calculating circuit, wherein said processing data calculating circuit computes processing data about the processing of the lens on the basis of the edge position calculated by said edge position calculating circuit;

a lens grinding section, mounted on said main base, including an abrasive wheel group;

a carriage section, including a chuck member, mounted on said main base so that at least a portion of said carriage section is movable relative to said lens grinding section; and processing control circuit which controls the movement of said carriage and said lens grinding section so as to process the lens on the basis of said processing data.

13. A lens grinding apparatus according to claim 12, further comprising a bevel-data calculating circuit which calculates a position of a bevel apex based on the edge position calculated by said edge position calculating circuit, and then causes said display device to display a simulated image representative of a target lens shape, to display a cursor, and to display a sectional shape of the lens edge at a position corresponding to said cursor, wherein said rotary dial is connected to said bevel-data calculating circuit so as to move said cursor in order to select a position at which the sectional shape is displayed, and wherein said rotary dial is connected to move said cursor in proportion to the direction and amount of rotation of said rotary dial.

14. A lens grinding apparatus according to claim 13, wherein said at least one move switch is connected to said bevel-data calculating circuit so as to cause, when depressed, said indicator to select an entry item corresponding to said bevel data, whereby said rotary dial can then vary the bevel data designated by said indicator.

15. A lens grinding apparatus according to claim 12, wherein said base includes a moving base and a rotating base which is rotatably and axially supported on the moving base, said moving block is connected to said rotating base, and said eyeglass frame configuration measuring device further includes a spring which biases said moving block to one position with respect to said rotating base.

16. A lens grinding apparatus according to claim 12, wherein said gage head is connected to a shielding plate which moves along with said gage head, and said eyeglass frame configuration measuring device further includes a light source and a light detector connected to said base, said light source and said light detector being mounted adjacent opposite sides of said shielding plate.

* * * * *